US012312879B2

(12) United States Patent
Farley et al.

(10) Patent No.: US 12,312,879 B2
(45) Date of Patent: May 27, 2025

(54) RASPING SHOE FOR NON-ROTATIONAL DEPLOYMENT OF CASING STRING

(71) Applicant: DOWNHOLE PRODUCTS LIMITED, Aberdeen (GB)

(72) Inventors: Douglas Farley, Missouri City, TX (US); Alexander Craig Mackay, Aberdeen (GB); Carl Aron Deen, Choctaw, OK (US)

(73) Assignee: DOWNHOLE PRODUCTS LIMITED

( * ) Notice: Subject to any disclaimer, the term of this patent is extended or adjusted under 35 U.S.C. 154(b) by 102 days.

(21) Appl. No.: 18/332,158

(22) Filed: Jun. 9, 2023

(65) Prior Publication Data

US 2024/0011359 A1 Jan. 11, 2024

Related U.S. Application Data

(60) Provisional application No. 63/358,545, filed on Jul. 6, 2022.

(51) Int. Cl.
*E21B 17/14* (2006.01)
*E21B 10/43* (2006.01)
*E21B 10/55* (2006.01)

(52) U.S. Cl.
CPC ..... *E21B 17/14* (2013.01); *E21B 10/43* (2013.01); *E21B 10/55* (2013.01)

(58) Field of Classification Search
CPC ..... E21B 10/43; E21B 10/55; E21B 10/56; E21B 17/1092; E21B 17/14
See application file for complete search history.

(56) References Cited

U.S. PATENT DOCUMENTS

| | | | | |
|---|---|---|---|---|
| 5,855,247 | A * | 1/1999 | Scott | E21B 10/52 175/428 |
| 6,401,820 | B1 | 6/2002 | Kirk | |
| 6,983,811 | B2 | 6/2006 | Wardley | |
| 7,621,351 | B2 | 11/2009 | Clark | |
| 7,896,110 | B2 | 3/2011 | Bain | |
| D892,868 | S * | 8/2020 | Bradford | D15/139 |
| 10,900,290 | B2 | 1/2021 | Howard | |
| 2002/0189863 | A1 | 12/2002 | Wardley | |
| 2008/0236813 | A1* | 10/2008 | Bain | E21B 17/14 166/242.8 |
| 2009/0229887 | A1* | 9/2009 | Tedeschi | E21B 10/16 29/428 |

(Continued)

FOREIGN PATENT DOCUMENTS

| | | | | |
|---|---|---|---|---|
| WO | 2011/025488 | A1 | 3/2011 | |
| WO | WO-2011049864 | A2 * | 4/2011 | E21B 10/43 |

OTHER PUBLICATIONS

Extended European Search Report and Opinion for application 23177600.6 and dated Nov. 6, 2023.

*Primary Examiner* — Caroline N Butcher

(57) ABSTRACT

A rasping shoe for non-rotational deployment of a casing string into a wellbore includes: a tubular body; and a nose mounted to an end of the tubular body. The nose includes: a base portion made from a drillable metal or alloy; a plurality of blades protruding from an outer surface of the base portion; a plurality of broaching cutters mounted to an outer surface of each blade at a rearward portion thereof; and a plurality of gouging cutters mounted to the outer surface of each blade at a forward portion thereof.

13 Claims, 7 Drawing Sheets

(56) References Cited

U.S. PATENT DOCUMENTS

| | | | | |
|---|---|---|---|---|
| 2010/0252331 | A1 | 10/2010 | High | |
| 2010/0263875 | A1* | 10/2010 | Williams | E21B 7/20<br>166/173 |
| 2017/0130536 | A1 | 5/2017 | Stam | |

* cited by examiner

RASPING SHOE FOR NON-ROTATIONAL DEPLOYMENT OF CASING STRING

BACKGROUND OF THE DISCLOSURE

Field of the Disclosure

The present disclosure generally relates to a rasping shoe for non-rotational deployment of a casing string.

Description of the Related Art

U.S. Pat. No. 6,401,820 discloses a tubing shoe including: a body for mounting on the end of a tubing string; and reaming members extending longitudinally and helically around the body, the reaming members providing substantially complete circumferential coverage of the body whereby, in use, when the tubing shoe is advanced axially into a bore, the reaming members provide reaming around the shoe circumference. A rotatable torque reducing sleeve or centralizer may also be mounted on the body, rearwardly of the reaming members.

U.S. Pat. No. 6,983,811 discloses a reamer shoe for mounting on a tubing string having a reaming area supporting a plurality of discrete reaming members typically formed as simple geometrical shapes. The reaming members provide complete circumferential coverage of the shoe body but the individual reaming members are non-continuous and do not fully extend either longitudinally along or circumferentially around the reaming area on the shoe body. The invention therefore provides a reamer shoe for reaming a bore in preparation for receiving casing, which is effective on rotation or reciprocation, regardless of direction or speed.

U.S. Pat. No. 7,621,351 discloses a reaming tool including a tubular body having a nose portion with a concave center. A plurality of blades defining junk slots therebetween extend axially behind the nose portion and taper outwardly from the exterior of the tubular body. Rotationally leading edges of the blades carry a plurality of cutting elements from the axially leading ends. Selected surfaces and edges of the blades bear tungsten carbide, which may comprise crushed tungsten carbide. The shell of the nose is configured to ensure drillout from the centerline thereof toward the side wall of the tubular body. A method of drilling out a reaming tool is also disclosed.

U.S. Pat. No. 7,896,110 discloses a tubing shoe for use on work strings in well bores typically utilized in oil and gas production. The shoe comprises a cylindrical body upon which is arranged a reaming portion including pairs of teardrop shaped raised reaming members, each pair being mounted oppositely, in parallel and longitudinally along the body. Adjacent pairs of members provide a funnel for collecting approaching debris and a channel for grinding the debris. A nose may be mounted on the end of the shoe, the nose being eccentric or including cutting blades to assist the shoe in breaking through shale and clay stone bridges. A non-aggressive stabilizer in the form of helically arranged blades may also be located on shoe.

U.S. Pat. No. 10,900,290 discloses a completions bit for use in a wellbore including: a shank having a coupling formed at an upper end thereof; a body mounted to a lower end of the shank; and a cutting face forming a lower end of the bit. The cutting face includes: a blade protruding from the body; a tangentially oriented leading cutter mounted to a bearing face of the blade adjacent to a leading edge of the blade at an inner portion of the cutting face; and a radially oriented leading cutter mounted to the bearing face of the blade in proximity to the leading edge thereof at an outer portion of the cutting face.

US 2017/0130536 discloses a well casing or liner shoe including a partially or fully openable central fluid channel which is connected to at least one small width nozzle and an additional large width fluid outlet, which is closed by a thin walled closure device arranged to open at a selected fluid overpressure in the fluid channel, and which has a flow area larger than each nozzle to permit fluid circulation when the nozzles are clogged and clearance of clogging debris through the additional large width additional fluid outlet.

WO 2011/025488 discloses a casing shoe including a body, a nose connected to the body, and at least one composite protrusion attached to at least one of the body and the nose. A method of constructing a casing shoe, comprising preparing a surface of at least one of a body and a nose of the casing shoe, covering at least a portion of the prepared surface with an injection mold, and injecting a composite material into a space between the prepared surface and the injection mold.

SUMMARY OF THE DISCLOSURE

The present disclosure generally relates to a rasping shoe for non-rotational deployment of a casing or liner string. In one embodiment, a rasping shoe for non-rotational deployment of a casing string into a wellbore includes: a tubular body; and a nose mounted to an end of the tubular body. The nose includes: a base portion made from a drillable metal or alloy; a plurality of blades protruding from an outer surface of the base portion; a plurality of broaching cutters mounted to an outer surface of each blade at a rearward portion thereof; and a plurality of gouging cutters mounted to the outer surface of each blade at a forward portion thereof.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
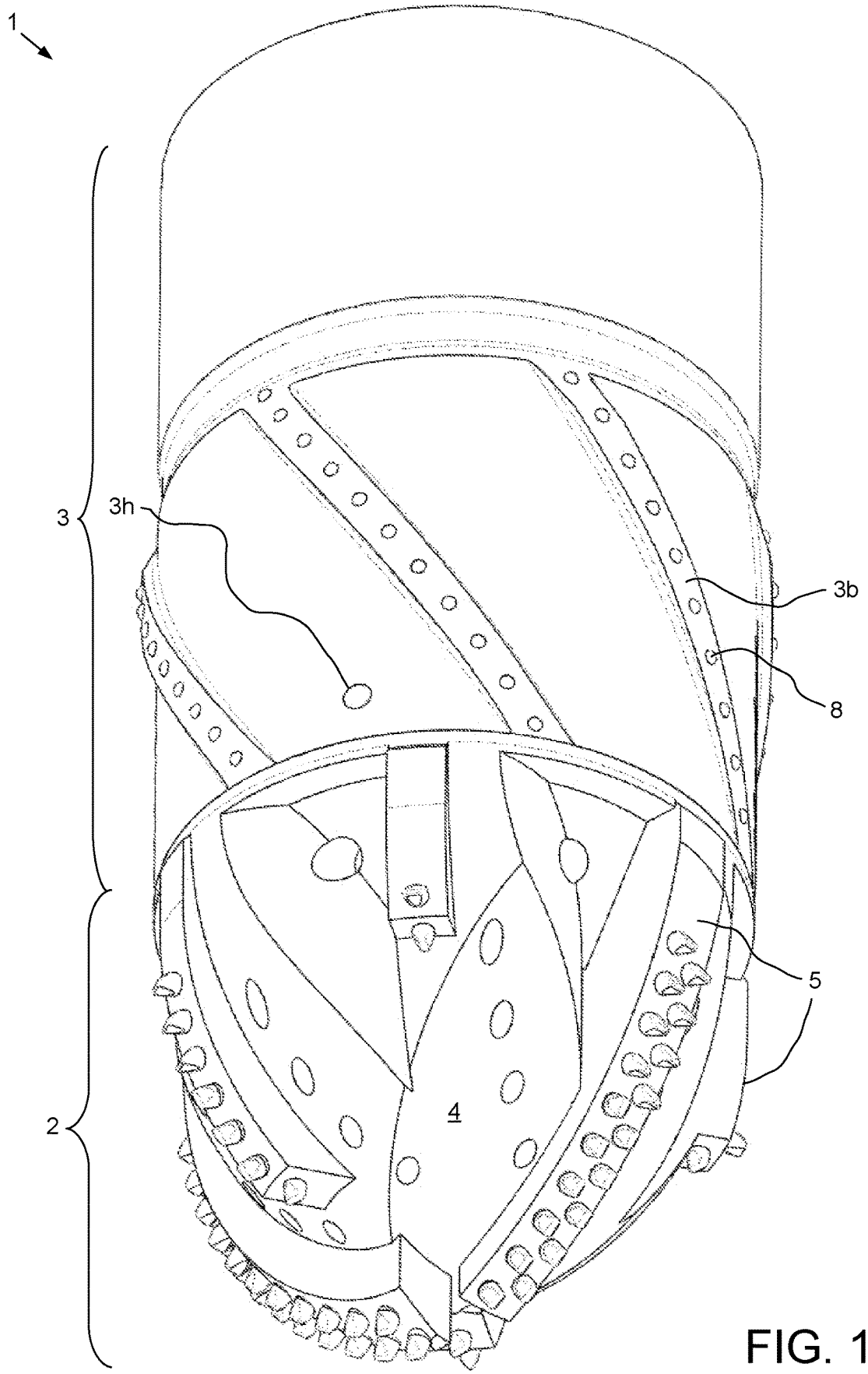
FIG. 1 illustrates a rasping shoe for non-rotational deployment of a casing string, according to one embodiment of the present disclosure.
Figure 2:
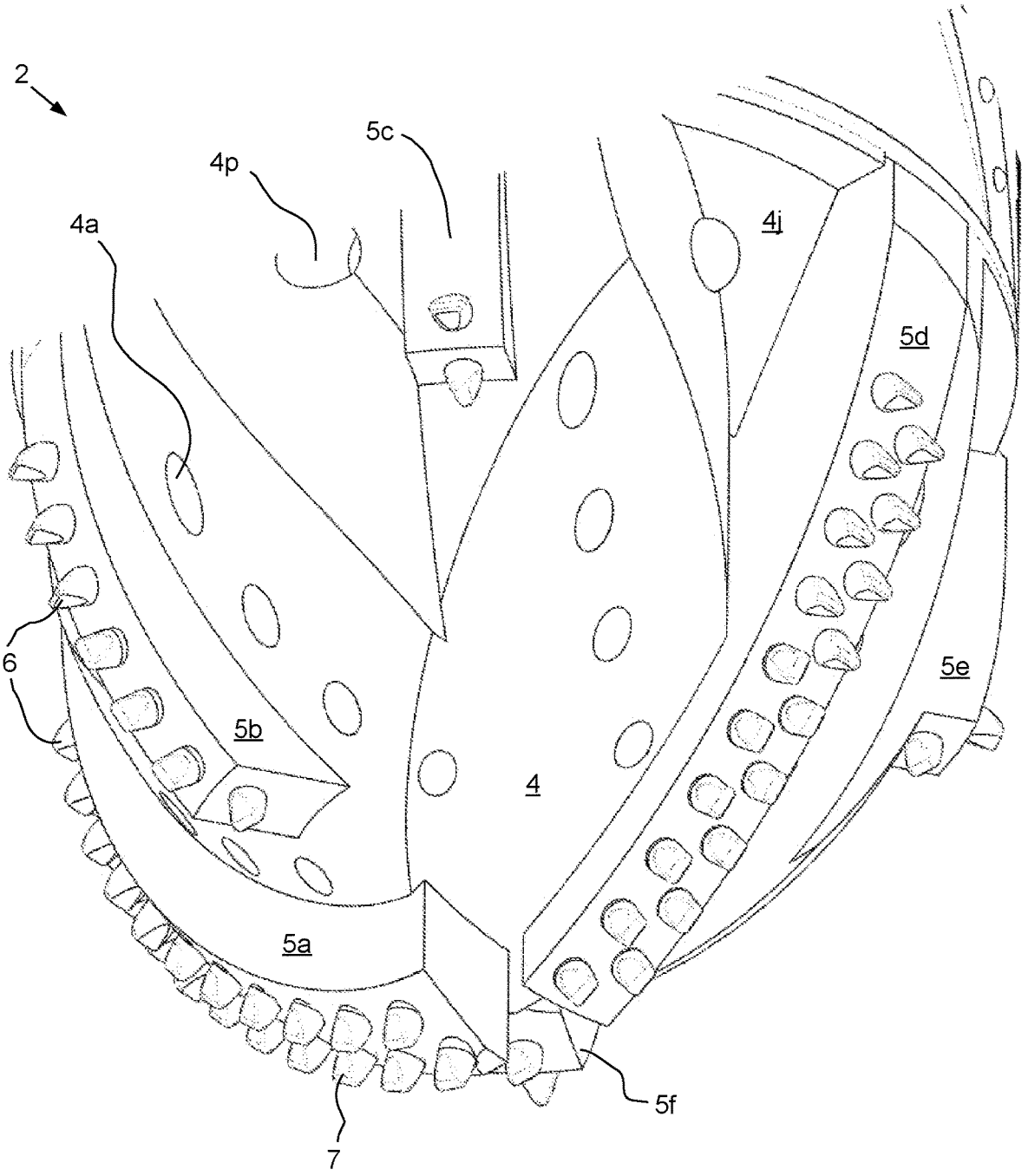
FIG. 2 illustrates a nose of the rasping shoe.
Figure 3:
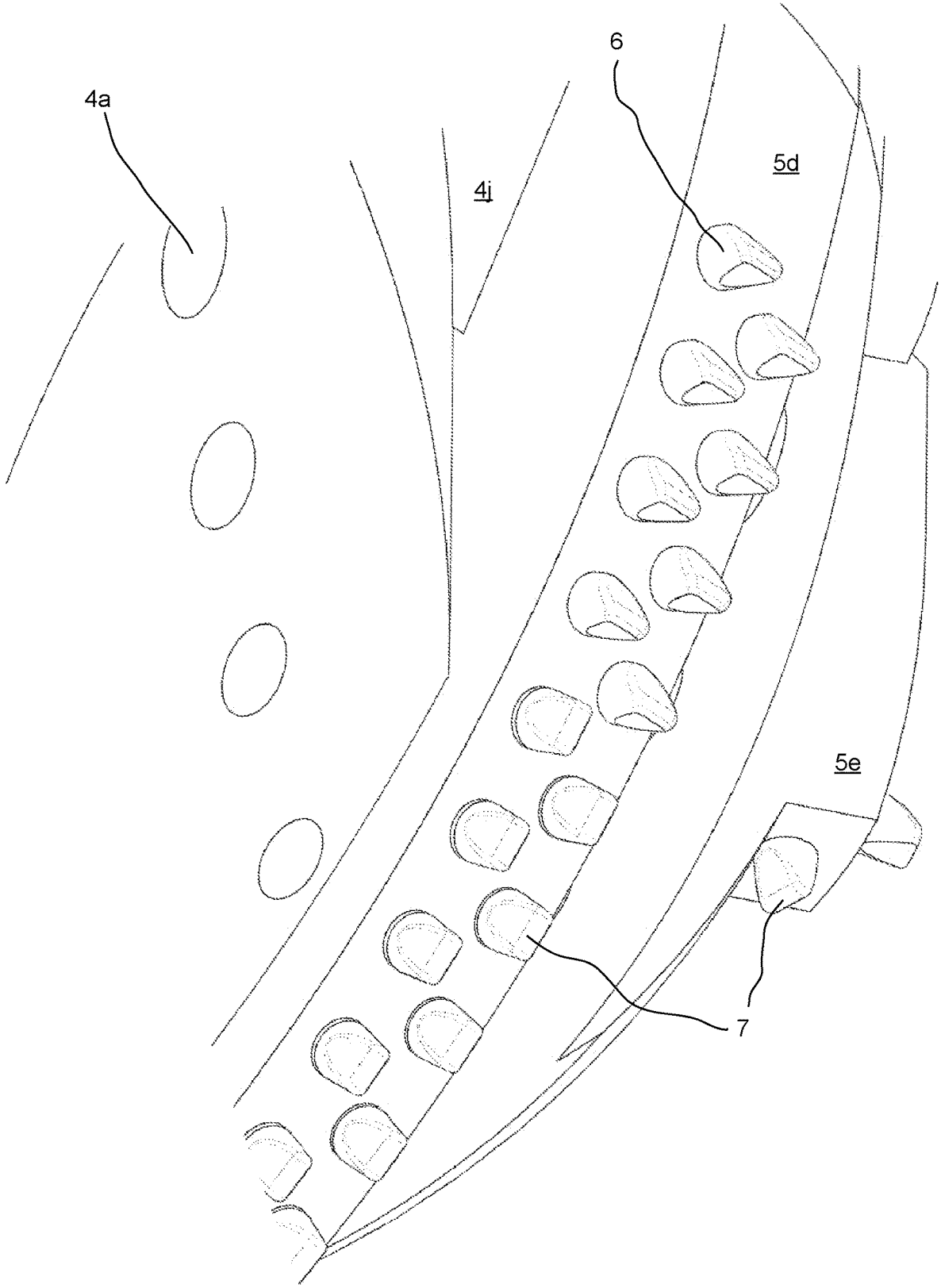
FIG. 3 illustrates one of the blades of the nose.
Figure 4A:
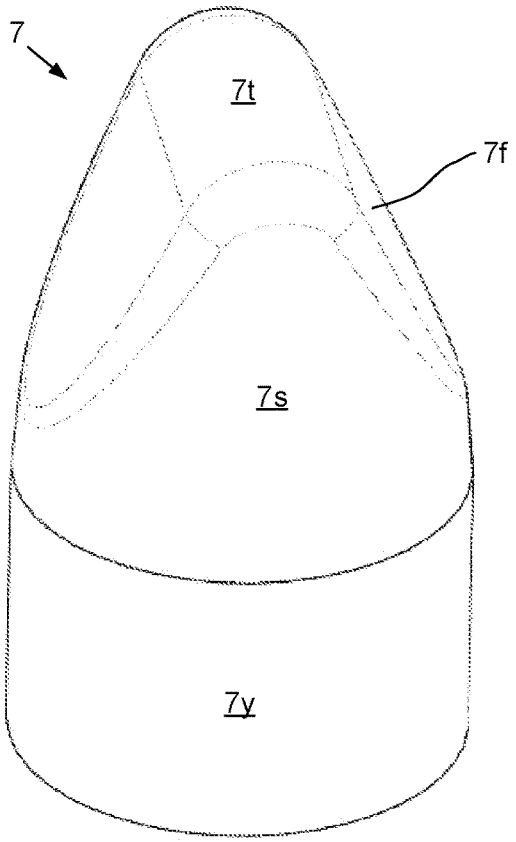
FIGS. 4A-4D illustrate a typical gouging cutter of the blades.
Figure 4B:
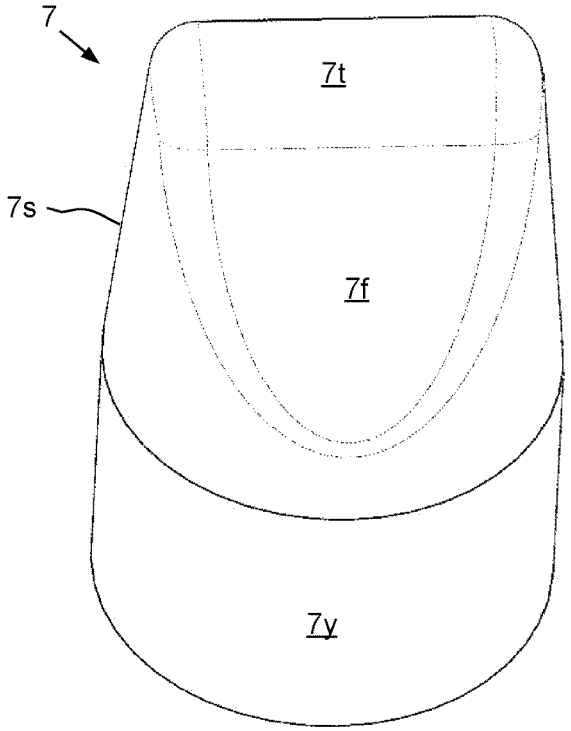
Figure 4C:
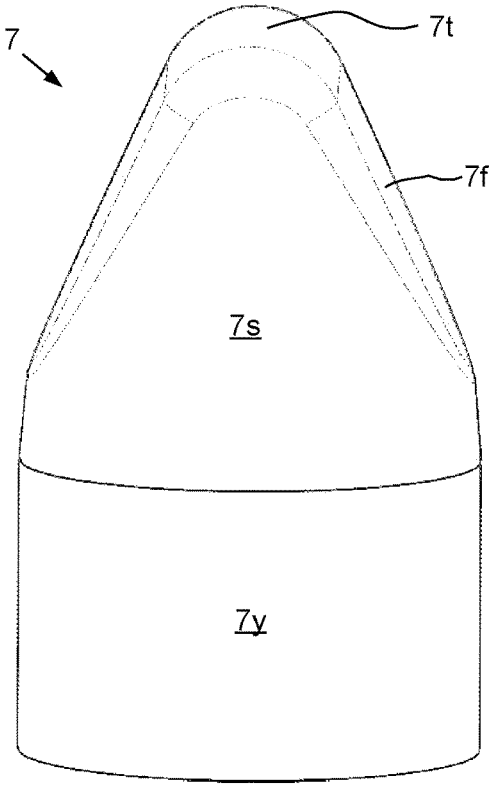
Figure 4D:
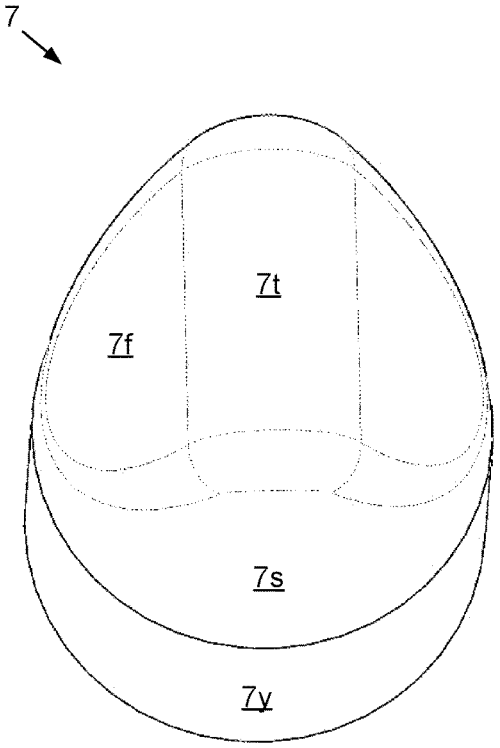
Figure 5A:
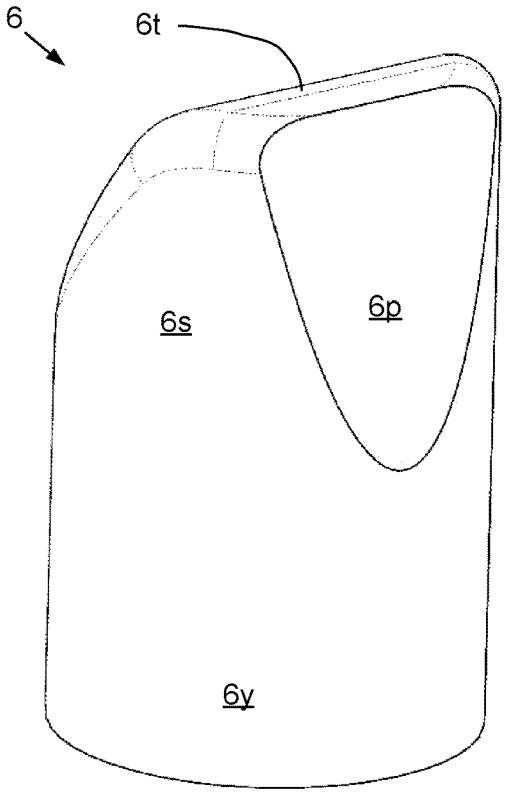
FIGS. 5A-5D illustrate a typical broaching cutter of the blades.
Figure 5B:
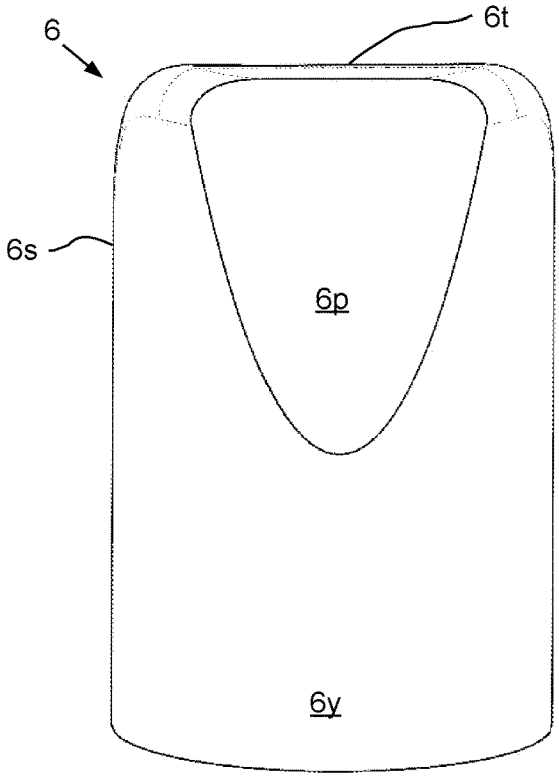
Figure 5C:
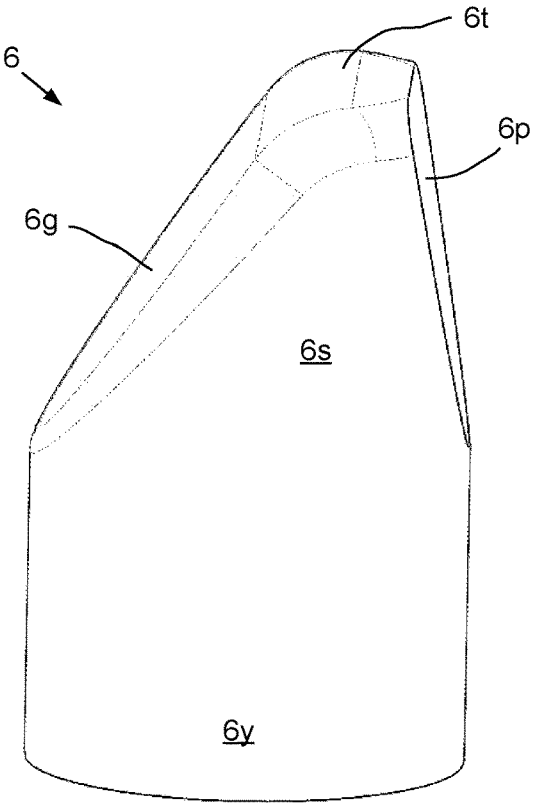
Figure 5D:
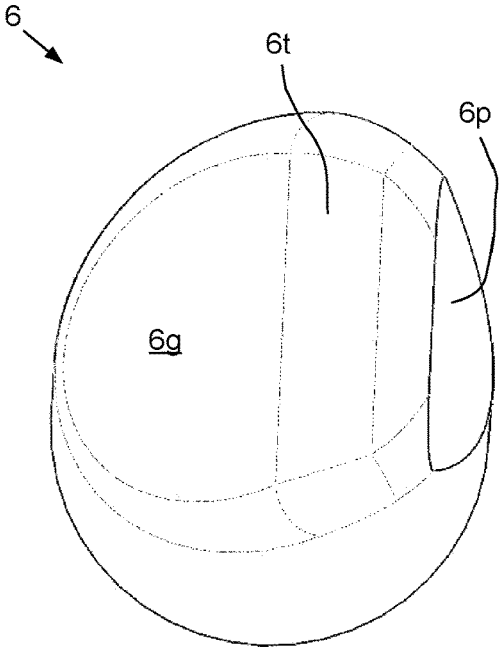

FIG. 1 illustrates a rasping shoe 1 for non-rotational deployment of a casing string (not shown), according to one embodiment of the present disclosure. FIG. 2 illustrates a nose 2 of the rasping shoe 1. FIG. 3 illustrates one 5*d* of the blades 5 of the nose 2. The rasping shoe 1 may include the nose 2 and a body 3.

The nose 2 may include a rearward shank portion (not shown), a forward base portion 4, and a plurality of blades 5 spaced around the base portion at regular intervals. The base portion 4 and blades 5 may be integrally formed, such as by casting. The base portion 4 may have an ogive shape. The nose 2 may be made from a metal or alloy. The metal or alloy may be drillable by a polycrystalline diamond compact (PDC) drill bit, such as being nonferrous, such as an aluminum alloy, such as aluminum-bronze. By nonferrous, it is meant that the material contains no more than a trace amount of iron.

Each blade 5*a-f* may be arcuate and may protrude from an outer surface of the base portion 4 and extend from an (visible) interface between the nose 2 and the body 3 along the outer surface of the base portion. One or more 5*a,d* of the blades may extend to a tip of the base portion 4 (aka primary blades) and one or more 5*b,c,e,f* of the blades may terminate before reaching the tip of the base portion (aka secondary blades). The primary 5*a,d* blades may be opposing (one-hundred eighty degrees apart) and the secondary 5*b,c,e,f* blades may be disposed therebetween. In a two-dimensional projection of the nose 2, each blade 5*a-f* may extend radially across (part of) the base portion 4. The base portion 4 may have a plurality of junk slots 4*j* formed in an outer surface thereof. Each junk slot 4*j* may be formed adjacent to one of the side surfaces of a respective blade 5. One or more 5*b,f* of the secondary blades may extend significantly further toward the tip of the base portion 4 than one or more 5*c,e* other ones of the secondary blades. The junk slots 4*j* may each extend from the interface between the nose 2 and the body 3 toward the tip of the base portion 4 to an extent slightly less than the longer secondary blades 5*b,f*. The junk slots 4*j* may each converge as they extend toward the tip of the base portion 4.

Alternatively, any or all of the blades 5*a-f* may follow a helical path around at least a part of the base portion 4 of the nose 2 for increased circumferential coverage thereof.

Each blade 5*a-f* may carry one or more broaching cutters 6 and/or gouging cutters 7 along an outer surface thereof and the primary blades 5*a,d* may have carry a plurality (two shown) staggered rows therealong. The types of cutters may be arranged according to location such that the broaching cutters 6 may only be disposed at a rearward portion of the blades 5 (proximate to the interface with the body 3) and the gouging cutters 7 may only be disposed at a forward portion of the blades (proximate to the tip of the base portion 4). Each secondary blade 5*b,c,e,f* may also carry a gouging cutter 7 at a forward end face thereof which may be a minor exception to the previous statement (for the shorter secondary blades 5*c,e*). The delineation between the rearward and forward portion of the blades 5 may be at a location of the base portion 4 corresponding to the forward end of the junk slots 4*j*. Each cutter 6, 7 may be made from a hard material, such a ceramic or cermet, such as tungsten carbide or cobalt-tungsten carbide. Each cutter 6, 7 may be an insert received in a socket formed in an outer surface of the respective blade 5*a-f* and mounted therein, such as by interference fit or brazing.

To facilitate drill out by a subsequent drill bit (not shown), the base portion 4 may have one or more blind fragmentation apertures 4*a* formed in an outer surface thereof and extending therein. The fragmentation apertures 4*a* may be arranged in rows and each row may be located between one of the blades 5 and the junk slot 4*j* of the next blade. Each row of fragmentation apertures 4*a* may extend from a location of the base portion 4 corresponding to the forward end face of the shorter secondary blades 5*c,e* to a location of the base portion corresponding to the forward end face of the longer secondary blades 5*b,f*.

The shank portion of the nose 2 may have a flow bore formed therethrough and the base portion 4 may have a plenum formed therein in fluid communication with the flow bore of the shank. The base portion 4 may have a flow port 4*p* formed at each junk slot 4*j* and extending through a wall thereof to be in fluid communication with the plenum. Each flow port 4*p* may be aimed downward and outward to discharge fluid pumped down through the bore of the casing string to wash cuttings formed by the rasping shoe 1 upward along an annulus formed between the casing string and the wellbore. An outer surface of the shank portion of the nose 2 may have a coupling, such as a threaded coupling, formed in an outer surface thereof for connection to the body 3.

The body 3 may be tubular and have a flow bore formed therethrough. The body 3 may be formed of a metal or alloy, such as steel. The body 3 may further have a plurality of blades 3*b* protruding from an outer surface thereof and extending there-along at an inclined angle or in a helical fashion relative to a longitudinal axis thereof. The blades 3*b* may be sized and arranged to cumulatively provide complete circumferential coverage around the body 3. The body 3 may have a coupling, such as a threaded coupling, formed at an inner surface of a forward end thereof for receiving the shank thread of the nose 2, thereby connecting the two members. The nose 2 may be screwed into the body 3 until almost tight and the body blades 3*b* may be aligned with the nose ports 4*p*. Fasteners, such as pins (not shown) may be inserted into holes 3*h* of the body and the sockets (not shown) of the nose 2, thereby torsionally locking the two members together. A plurality of buttons 8 may be mounted into sockets formed along the body blades 3*b*, such as by brazing or interference fit. Each button 8 may be an insert and may be made from the any of the materials discussed above for the cutters 6,7, discussed above. The body 3 may have a threaded coupling formed at a rearward end thereof for assembly of the rasping shoe 1 as part of the casing string. Each button 8 may have a cylindrical mounting portion and a hemispherical or quasi hemispherical shaped working portion.

In operation, the rasping shoe 1 is assembled as part of the casing string. The casing string, with the rasping shoe 1 at the front end thereof, is deployed into a crude oil and/or natural gas wellbore to a desired depth. As the casing sting is being deployed, fluid may be pumped therethrough. The rasping shoe 1 may guide the casing string into the wellbore and may cut through any obstructions encountered in the wellbore. Should lowering be halted by an onerous obstruction, the casing string 1 may be reciprocated to gouge and/or broach the onerous obstruction, thereby clearing the way for deployment to continue. Once the desired depth has been reached, the casing string may then be secured in place by pumping cement slurry into the annulus formed between the casing string and the wellbore. The nose 2 (except for the shank portion) may then be drilled through by a PDC drill bit of a subsequent drill string deployed into the wellbore for extending the depth of the wellbore.

Alternatively, the rasping shoe 1 may be drilled through by a PDC casing bit of a subsequent casing or liner string or a roller cone or hybrid drill bit of a subsequent drill string.

FIGS. 4A-4D illustrate a typical gouging cutter 7 of the nose blades 5. Each gouging cutter 7 may be a chisel cutter including a cylindrical portion 7*y* for mounting in a socket of one of the nose blades 5 and a cutting portion 7*c* extending from the cylindrical portion. The cutting portion 7*c* may have a pair of parabolic flanks 7*f* converging to form a crest 7*t* and a pair of quasi-conical sides 7*s* connecting the flanks 7*f* and crest to the cylindrical portion 7*y*. The flanks 7*f* may be symmetrical and planar. When mounted on an outer surface of the nose blades 5, each gouging cutter 7 may be oriented such that a longitudinal axis of the crest 7*t* is parallel to a longitudinal axis of the respective blade at the location of the respective gouging cutter along the respective blade.

Alternatively, the cutting portion 7*c* may be conical instead of chisel-shaped.

FIGS. 5A-5D illustrate a typical broaching cutter 6 of the nose blades 5. Each broaching cutter 6 may include a cylindrical portion 6*y* for mounting in a socket of one of the nose blades 5 and a cutting portion 6*c* extending from the cylindrical portion. The cutting portion 6*c* may have a gradual flank 6*g* and a steep flank 6*p* converging to form a crest 6*t* such that the cutting portion 6*c* is asymmetric about a cutting plane including a longitudinal axis of the crest and a longitudinal axis of the broaching cutter 6. The cutting portion 6*c* may further include a pair of quasi-conical sides 6*s* connecting the flanks 6*g,p* and crest 6*t* to the cylindrical portion 6*y*. The gradual flank 6*g* may be semi-circular and the steep flank 6*p* may be parabolic. When mounted on an outer surface of the nose blades 5, each broaching cutter 6 may be oriented such that a longitudinal axis of the crest 6*t* is perpendicular to a longitudinal axis of the respective blade at the location of the respective broaching cutter along the respective blade and is also oriented such that the steep flank faces forward along the respective blade toward the forward end face thereof.

Figure 6:
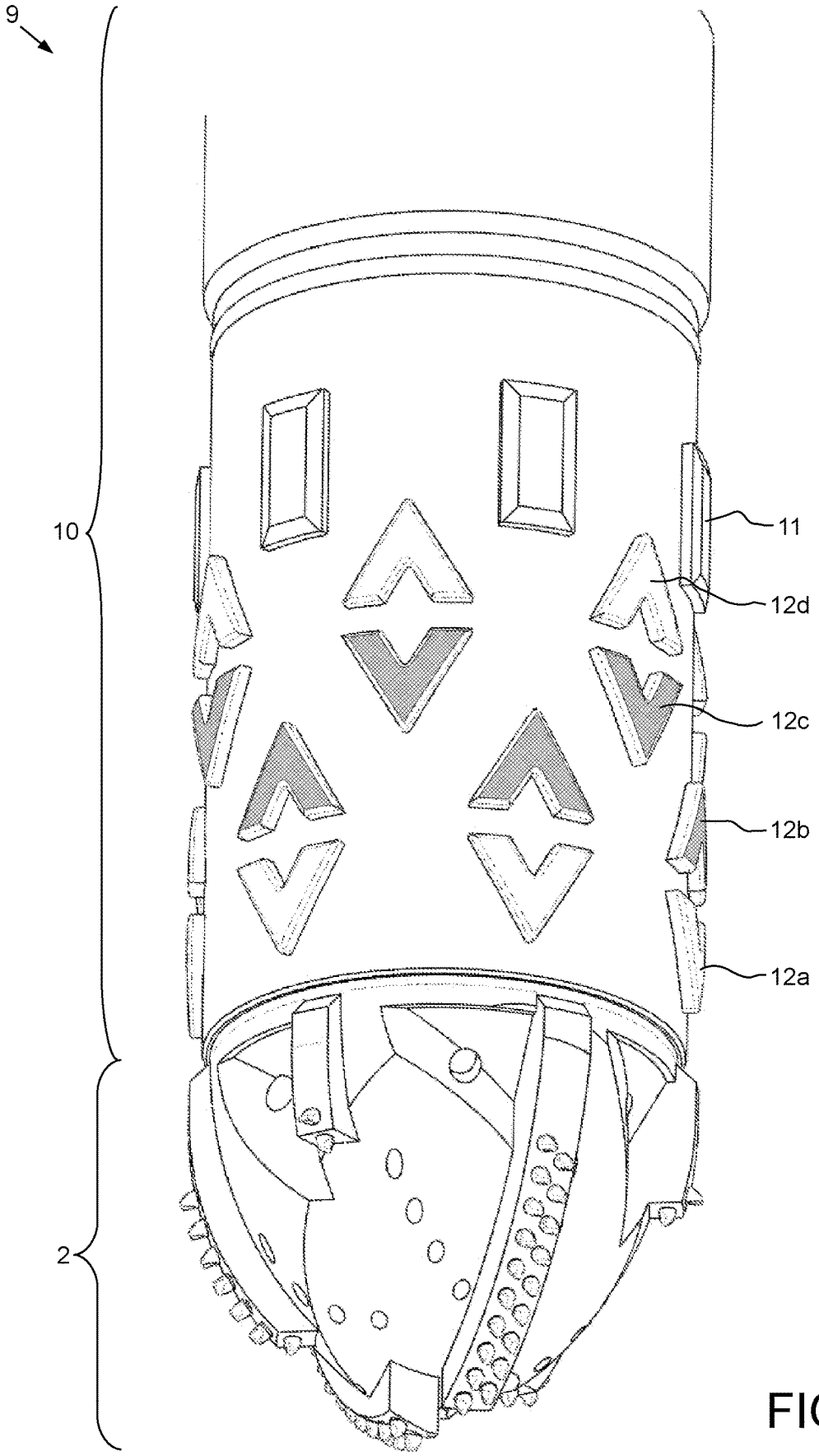
FIG. 6 illustrates a second rasping shoe for non-rotational deployment of a casing string, according to another embodiment of the present disclosure.

FIG. 6 illustrates a second rasping shoe 9 for non-rotational deployment of a casing string, according to another embodiment of the present disclosure. The second rasping shoe 9 may include the nose 2 and a second body 10. The second body 10 may be tubular and have a flow bore formed therethrough. The second body 10 may be formed of a metal or alloy, such as steel. The second body 10 may have a coupling, such as a threaded coupling, formed at an inner surface of a forward end thereof for receiving the shank thread of the nose 2, thereby connecting the two members. The second body 10 may have a threaded coupling formed at a rearward end thereof for assembly of the rasping shoe 1 as part of the casing string.

The second body 10 may have a row 11 of gage pads protruding from an outer surface thereof and formed integrally therewith. The row 11 of gage pads may be located proximate to the rearward threaded coupling of the second body. The row 11 of gage pads may be spaced around the outer surface of the second body 10 at regular intervals. Each gage pad may be rectangular.

The second body 10 may have one or more rows 12*a-d* of scraper pads protruding from an outer surface thereof, formed integrally therewith, and extending there-around to cumulatively provide complete circumferential coverage around the second body. The first row 12*a* of scraper pads may be located proximate to an (visible) interface between the second body 10 and the nose 2 and the fourth row 12*d* of scraper pads may be staggered with and slightly overlap a forward end of the row 11 of gage pads. The second 12*b* and third 12*c* rows of scraper pads may be disposed between the first 12*a* and fourth 12*d* rows thereof. Each row 12*a-d* of scraper pads may be spaced around the outer surface of the second body 10 at regular intervals. Each scraper pad may be V-shaped and the first 12*a* and third 12*c* rows thereof may be formed to point in a forward direction and the second 12*b* and fourth 12*d* rows thereof may be formed to point in a rearward direction. The first 12*a* and second 12*b* rows of scraper pads may be arranged in pairs such that each scraper pad of one row thereof is adjacent to and in alignment with a respective scraper pad of the other row thereof. The third 12*c* and fourth 12*d* rows of scraper pads may be arranged in pairs in a similar fashion as the first 12*a* and second 12*b* rows thereof. The first 12*a* and second 12*b* rows of scraper pads may be in alignment with the row 11 of gage pads and the second and third 12*c* rows of scraper pads may overlap.

Each scraper pad of one or more (rows 12*b,c* shown) of the rows 12*a-d* thereof may have hard material bonded to an outer surface thereof. The rest of the rows 12*a,d* of scraper pads may have bare outer surfaces (no hard material bonded thereto). The hard material may be crushed cermet particles, such as cobalt-tungsten carbide, and bonded to the scraper pads by a metal or alloy, such as a copper alloy. Each hard particle may have a minimum primary dimension (length, width, height) greater than or equal to one-eighth of an inch (three millimeters), three-sixteenths of an inch (five millimeters), or one-quarter of an inch (six millimeters). The particles may be procured as composite rods and deposited onto the scraper pads by oxyacetylene welding.

Alternatively, the particles of hard material may be sintered blocks procured as a rod (not shown) formed with a tinning binder which allows rapid brazing of the blocks on the scraper pads. Alternatively, the scraper pads may be hardfaced.

Figure 7:
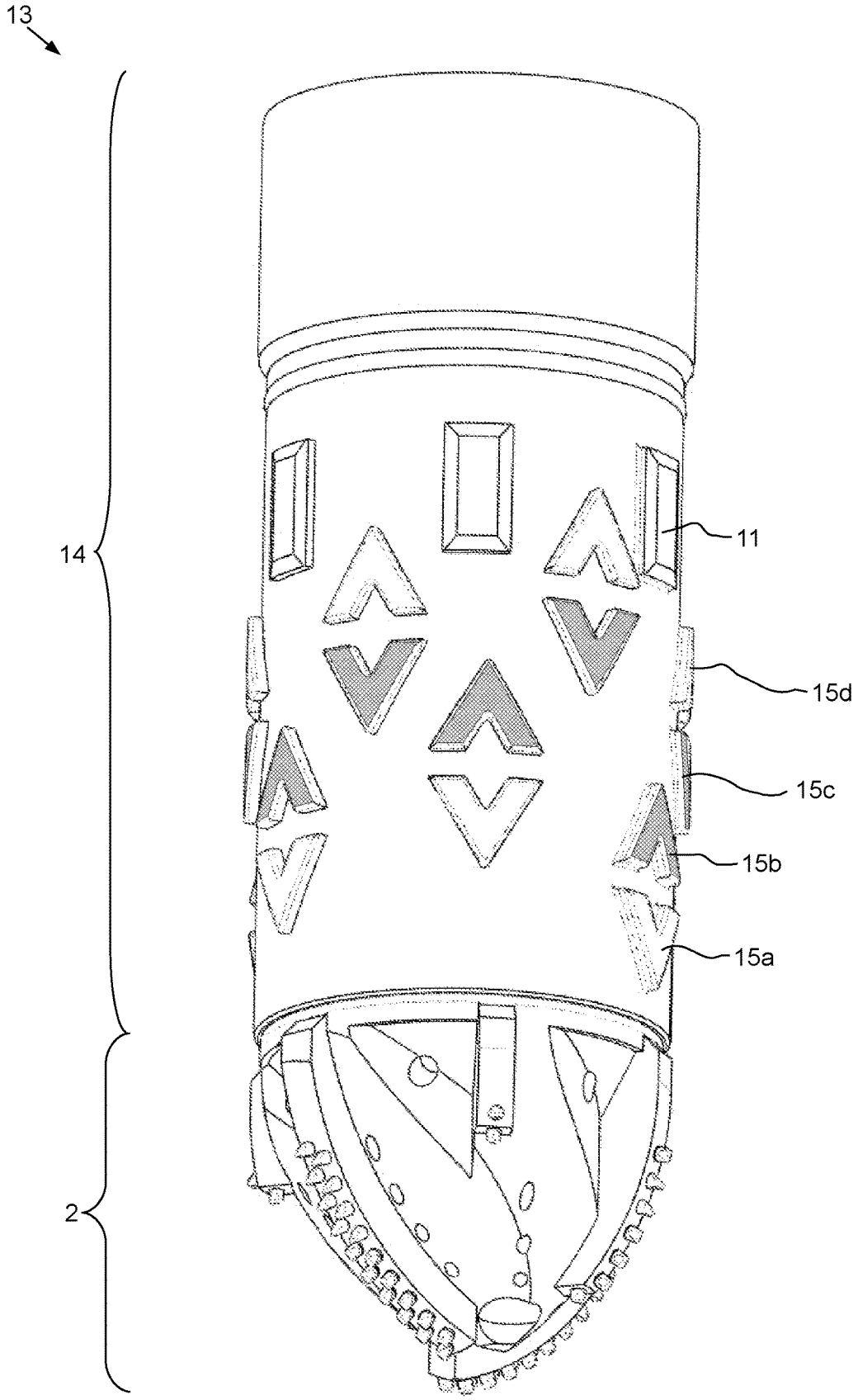
FIG. 7 illustrates a third rasping shoe for non-rotational deployment of a casing string, according to another embodiment of the present disclosure.

FIG. 7 illustrates a third rasping shoe 13 for non-rotational deployment of a casing string, according to another embodiment of the present disclosure. The third rasping shoe 13 may include the nose 2 and a third body 14. The third body 14 may be similar or identical to the second body except that the scraper pads are arranged in offset arrays 15*a-d* instead of the rows 12*a-d*. The offset arrays 15*a-d* may allow the scrapers 15*a-d* to sequentially engage an obstruction in the wellbore instead of simultaneous engagement of the second rasping shoe 9.

While the foregoing is directed to embodiments of the present disclosure, other and further embodiments of the disclosure may be devised without departing from the basic scope thereof, and the scope of the invention is determined by the claims that follow.

The invention claimed is:

1. A rasping shoe for non-rotational deployment of a casing string into a wellbore, comprising:

a tubular body; and a nose mounted to an end of the tubular body and comprising a base portion made from a drillable metal or alloy;

a plurality of blades protruding from an outer surface of the base portion;

a plurality of broaching cutters mounted to an outer surface of each blade at a rearward portion thereof; and a plurality of gouging cutters mounted to the outer surface of each blade at a forward portion thereof, wherein:

each gouging cutter and each broaching cutter comprises a pair of flanks converging to form a crest, each gouging cutter is oriented such that a longitudinal axis of the crest is parallel to a longitudinal axis of the respective blade at the location of the respective gouging cutter along the respective blade, each broaching cutter is oriented such that a longitudinal axis of the crest is perpendicular to a longitudinal axis of the respective blade at the location of the respective broaching cutter along the respective blade, one of the flanks of each broaching cutter is a steep flank, another one of the flanks of each broaching cutter is a gradual flank, and each broaching cutter is also oriented such that the steep flank faces forward along the respective blade toward a forward end face of the respective blade.

2. The rasping shoe of claim 1, wherein:

the blades are primary blades extending to a tip of the base portion, and the nose further comprises:

a secondary blade protruding from an outer surface of the base portion, and a gouging cutter mounted to a forward end face of the secondary blade.

3. The rasping shoe of claim 1, wherein:

the base portion has a plurality of junk slots formed in an outer surface thereof, each junk slot is located adjacent to a respective blade.

4. The rasping shoe of claim 3, wherein the base portion has a flow port formed at each junk slot and extending through a wall thereof.

5. The rasping shoe of claim 1, wherein:

the tubular body has a plurality of blades protruding from an outer surface thereof and extending there-around, the rasping shoe further comprises a plurality of buttons mounted to an outer surface of each body blade.

6. The rasping shoe of claim 1, wherein the tubular body has a plurality of scraper pads protruding from an outer surface thereof and extending there-around.

7. The rasping shoe of claim 6, wherein each scraper pad is V-shaped.

8. The rasping shoe of claim 7, wherein:

the tubular body has a first set of the scraper pads extending there-around and pointed in a forward direction, and the tubular body has a second set of the scraper pads extending there-around and pointed in a rearward direction.

9. The rasping shoe of claim 8, wherein each set is arranged in a row.

10. The rasping shoe of claim 8, wherein each set is arranged in an offset array.

11. The rasping shoe of claim 8, wherein:

the tubular body is made from steel, and one of the sets of scraper pads has cermet particles bonded to an outer surface of the scraper pads.

12. The rasping shoe of claim 11, wherein each particle has a minimum primary dimension greater than or equal to 3 millimeters.

13. The rasping shoe of claim 1, wherein the base portion has an ogive shape.

* * * * *